US010094351B2

(12) United States Patent
Oh et al.

(10) Patent No.: US 10,094,351 B2
(45) Date of Patent: Oct. 9, 2018

(54) INJECTOR CLIP

(71) Applicant: HYUNDAI KEFICO CORPORATION, Gunpo, Gyeonggi-do (KR)

(72) Inventors: Seung Hyuk Oh, Gyeonggi-do (KR); Young Il Kang, Gyeonggi-do (KR); Kwang Won Koo, Seoul (KR); Myeong Hun Kweon, Gyeonggi-do (KR); Yeon Jee Oh, Seoul (KR)

(73) Assignee: HYUNDAI KEFICO CORPORATION, Gunpo, Gyeonggi-do (KR)

( * ) Notice: Subject to any disclaimer, the term of this patent is extended or adjusted under 35 U.S.C. 154(b) by 0 days.

(21) Appl. No.: 15/621,357

(22) Filed: Jun. 13, 2017

(65) Prior Publication Data

US 2017/0356413 A1 Dec. 14, 2017

(30) Foreign Application Priority Data

Jun. 13, 2016 (KR) ..... 10-2016-0073172

(51) Int. Cl.
*F02M 61/14* (2006.01)

(52) U.S. Cl.
CPC ..... *F02M 61/14* (2013.01); *F02M 2200/853* (2013.01)

(58) Field of Classification Search
CPC ..... F02M 61/14; F02M 2200/8023; F02M 2200/853
USPC ..... 123/470
See application file for complete search history.

(56) References Cited

U.S. PATENT DOCUMENTS 5,501,195 A * 3/1996 Hall ..... F02M 61/145 123/470
5,893,351 A * 4/1999 Akutagawa ..... F02M 51/005 123/456
5,970,953 A 10/1999 Lorraine et al.
7,063,075 B2 * 6/2006 Berger ..... F02M 61/14 123/456
8,408,184 B2 * 4/2013 Marc ..... F02M 55/025 123/456
8,707,930 B2 * 4/2014 Bolz ..... F02M 55/004 123/470

FOREIGN PATENT DOCUMENTS

KR 10-2015-0007263 A 1/2015

* cited by examiner

*Primary Examiner* — Hai Huynh
(74) *Attorney, Agent, or Firm* — Mintz Levin Cohn Ferris Glovsky and Popeo, P.C.; Kongsik Kim

(57) ABSTRACT

An injector clip includes a lower plate formed to support a fuel injection portion of an injector, a base plate is formed to engage with and support a connection portion of the injector and an engagement support portion elastically supports the lower plate and the base plate to return the fuel injection portion to an original position after being displaced. A spring arm is formed by extending from the base plate to support a fuel inlet portion of the injector. Accordingly the load resulting from fuel injection of a fuel injector is attenuated and p a fuel injection device is prevented from rotating.

8 Claims, 6 Drawing Sheets

INJECTOR CLIP

CROSS-REFERENCE TO RELATED APPLICATIONS

This application claims priority to Korean Application No. 10-2016-0073172 filed on Jun. 13, 2016, which is incorporated herein by reference.

BACKGROUND

1. Field of the Disclosure

The present disclosure relates to an injector clip, and more particularly, to an injector clip for attenuating load resulting from fuel injection of a fuel injection device.

2. Description of the Related Art

Generally, in a gasoline direct injection (GDI) engine system, a fuel injection device injects fuel that is compressed to a high pressure in a pump and delivers the fuel to a fuel rail and then to a combustion chamber of an engine. During fuel injection, the fuel injection device is subjected to force in a direction that corresponds to a fuel-injection direction and the fuel injection device operates in an unstable engagement state. Therefore, a component for attenuating load resulting from fuel injection of the fuel injection device and preventing rotation of the fuel injection device has been applied.

In particular, the component is required to have durability to withstand a fatigue fracture phenomenon occurs in a cyclic loading environment resulting from the fuel injection. Additionally, mechanical performance in an elastic region is required to sufficiently attenuate a reaction force. Accordingly, a large number of fixing clips for fuel injection devices have been developed.

The above information disclosed in this section is merely for enhancement of understanding of the background of the disclosure and therefore it may contain information that does not form the prior art that is already known in this country to a person of ordinary skill in the art.

SUMMARY

The present disclosure provides an injector clip capable of reducing impact generated during fuel injection. In accordance with one aspect of an exemplary embodiment of the present disclosure, an injector clip may include a lower plate that supports a fuel injection portion of an injector, a base plate that engages and supports a connection portion of the injector, an engagement support portion that elastically supports the lower plate and the base plate to return a the fuel injection portion to an original position when the fuel injection portion is displaced, and a spring arm formed by extending from the base plate to support a fuel inlet portion of the injector.

In particular, the injector clip according to an exemplary embodiment of the present disclosure may include a lower spring arm formed by extending from the lower plate and being bent in a direction toward the base plate to reinforce supporting force of the engagement support portion. In other words, the lower plate may be formed having a first end connected to the engagement support portion, an interior portion formed with a first seating aperture that seats the connection portion thereon and a second end is formed to be opened to communicate with the first seating aperture. Further, the lower plate may be formed having the connection portion inserted into the first seating aperture and that abuts an end face of the fuel injection portion in the direction of the fuel inlet portion to elastically support the fuel injection portion.

In some exemplary embodiments the base plate may be formed with a first end coupled to the engagement support portion, an interior portion formed with a second seating aperture that allows the connection portion to be seated thereon and a second end formed to be opened to communicate with the second seating aperture. Further, the base plate may be formed to receive the connection portion and may be supported by the second seating aperture.

The engagement support portion may be integrally formed with both the lower plate and the base plate and formed by being bent twice having the lower plate and the base plate disposed parallel with each other. Further, the spring arm may be formed having a first end coupled to the base plate and formed by being bent convexly with respect to the base plate and a second end in contact with the fuel inlet portion and formed having width of a face connected to the base plate greater than width of a face that abuts the fuel inlet portion.

Moreover, the lower spring arm may be configured to be bent in a direction from the second end of the lower plate toward the base plate having the lower spring arm that covers a bottom face of the base plate or abuts the bottom surface of the base plate. As described above, the injector clip according to an exemplary embodiment of the present disclosure may attenuate the load resulting from fuel injection and a fuel injection device may be prevented from rotating.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

An exemplary embodiment of the present disclosure will be described below in more detail with reference to the accompanying drawings. The present disclosure may, however, be embodied in different forms and should not be construed as limited to the embodiments set forth herein. While the invention will be described in conjunction with exemplary embodiments, it will be understood that present description is not intended to limit the invention to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 1:
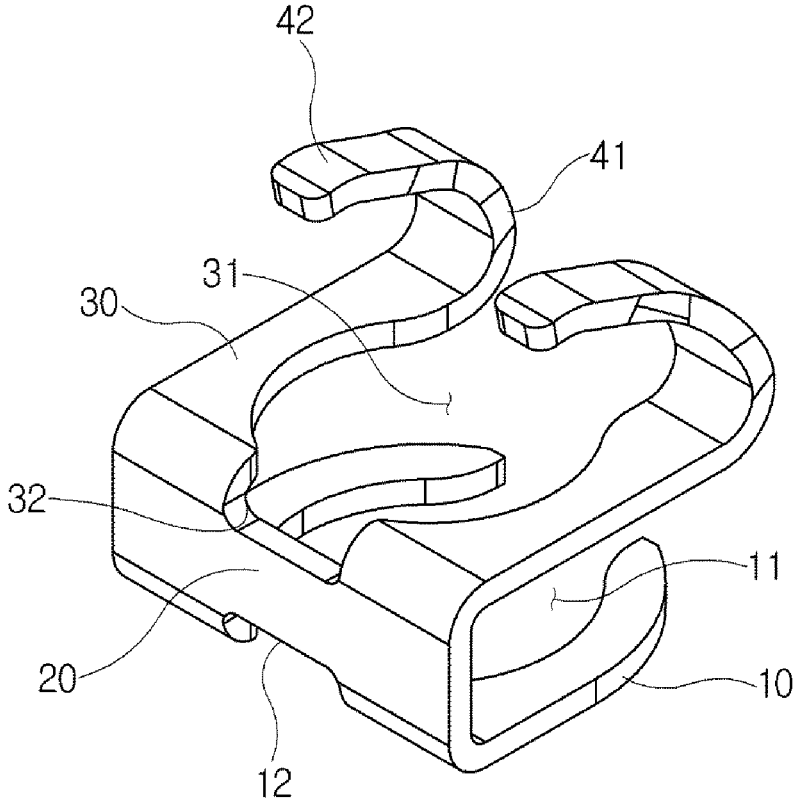
FIG. 1 is an exemplary perspective view of an injector clip according to an exemplary embodiment of the present disclosure.
Figure 2:
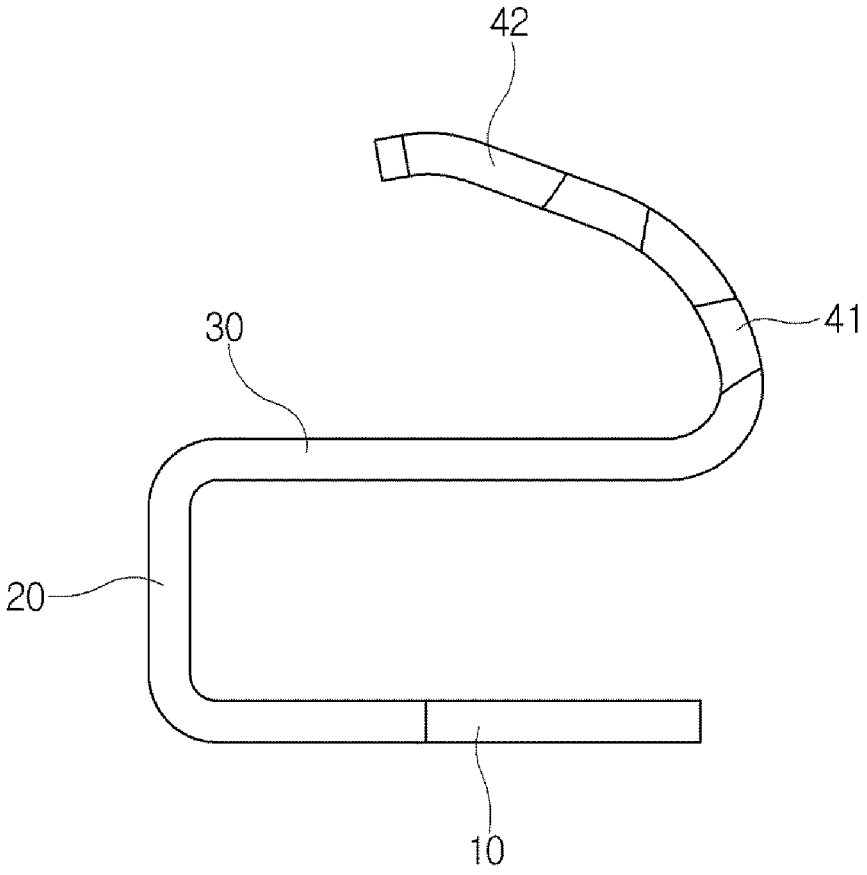
FIG. 2 is an exemplary side view of FIG. 1 according to an exemplary embodiment of the present disclosure.
Figure 3:
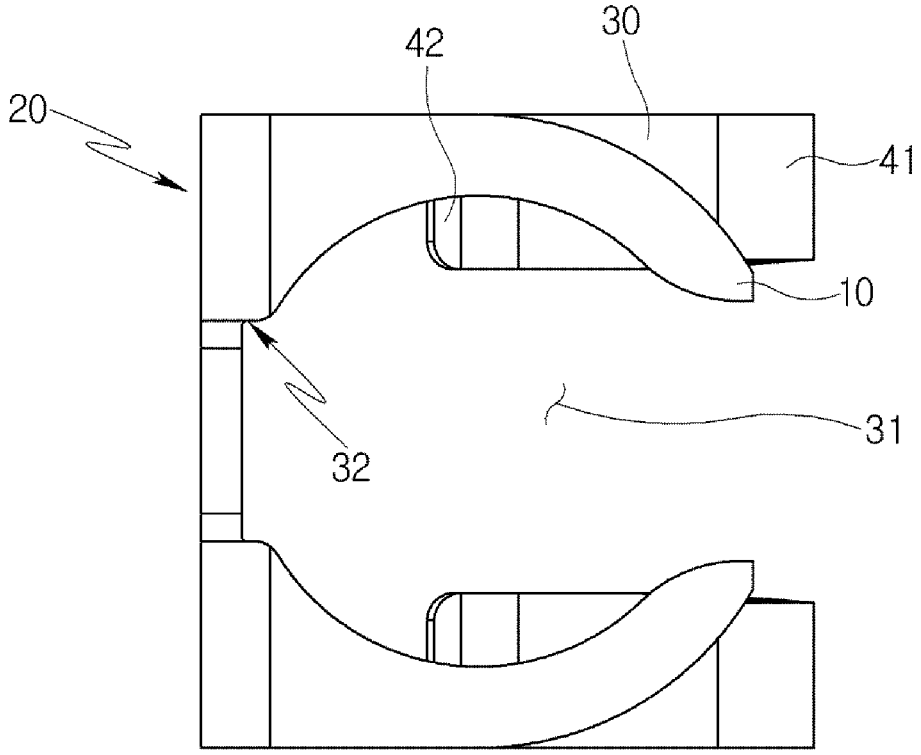
FIG. 3 is an exemplary bottom view of FIG. 1 according to an exemplary embodiment of the present disclosure.

Referring to FIGS. 1 to 3, an injector clip according to an exemplary embodiment of the present disclosure may include a lower plate 10, an engagement support portion 20, a base plate 30 and a spring arm 40. In particular, the lower plate 10 may be coupled to the engagement support portion 20, the engagement support portion 20 may be coupled to the base plate 30 and the base plate 30 may be coupled to the spring arm 40.

The lower plate 10 may include a first seating aperture 11 and a first attachment or detachment recess 12. A first end of the lower plate 10 may be connected to the engagement support portion 20. The interior portion of the lower plate 10 may be formed with the first seating aperture 11 in the form of a circular aperture. The second end of the lower plate 10 may be opened to communicate with the first seating aperture 11. In other words, the lower plate 10 may be formed with a horseshoe-shaped aperture. The attachment or detachment recess 12 may be formed in the direction from the first seating aperture 11 toward the engagement support portion 20. A first end of the engagement support portion 20 may be coupled to the lower plate 10 and a second end of the engagement support portion may be coupled to the base plate 30 and may be formed in a semi-circular shape (e.g., "⊂") shape by being bent twice.

The base plate 30 may include a second seating aperture 31 and a second attachment or detachment recess 32. A first end of the base plate 30 may be coupled to the engagement support portion 20 and the interior portion of the base plate 30 may be formed with the second seating aperture 31 in the form of a circular aperture. Further, the second end of the base plate 30 may be connected to the spring arm 40 and opened to communicate with the second seating aperture 31. In other words, the base plate 30 may be formed with a horseshoe-shaped aperture. The first attachment or detachment recess 32 may be formed in the direction from the second seating aperture 31 toward the engagement support portion 20.

The spring arm 40 may include a plate connection portion 41 and an injector contact portion 42 and may be formed having a pair of cantilevers formed by extending from the base plate 30. A first end of the spring arm 40 may be formed with the plate connecting portion 41 and a second end of the spring arm may be formed with the injector contact portion 42. In particular, the plate connection portion may be coupled to the base plate 30 and bent in a curved convex shape with respect to the base plate 30. Width of the plate connection portion 41 may be greater than the width of the injector contact portion 42.

Accordingly, referring to FIG. 2, shape of the injector clip according to an exemplary embodiment of the present disclosure may have the engagement support portion 20 formed by extending and being bent from the lower plate 10. The base plate 30 may be formed by being bent and extending from the engagement support portion 20 to be parallel with the lower plate 10. The spring arm 40 may be formed by being bent convexly with respect to the base plate 30. The lower plate 10, the engagement support portion 20, the base plate 30 and the spring arm 40 of injector clip according to the present disclosure may be made of a material having an elasticity property.

Figure 6:
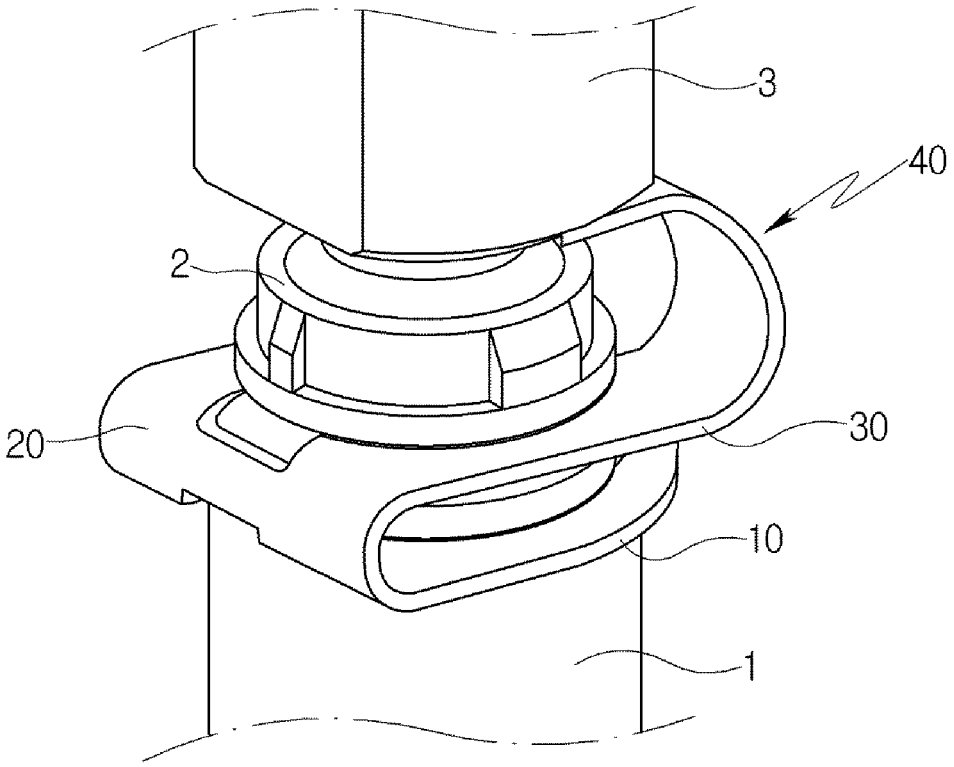
FIG. 6 is an exemplary view of an injector clip according to an exemplary embodiment of the present disclosure when the injector clip is used.

Referring to FIG. 6, an injector will now be briefly described in order to facilitate understanding the injector clip according to an exemplary embodiment of the present disclosure. The injector may include a fuel injection portion 1, a connection portion 2 and a fuel inlet portion 3. In other words, the fuel inlet portion 3 may be coupled to a fuel pipe (not shown). The fuel inlet portion 3 at the opposite side of the fuel pipe (hereinafter, referred to as a downward direction) may be coupled to the connection portion 2 when the fuel injection portion 1 is connected to a lower side of the connection portion 2. In other words, the fuel inlet portion 3, the connection portion 2 and the fuel injection portion 1 may be connected linearly on a common axis.

When the injector is operated, fuel accelerated in the injector may be injected through the fuel injection portion 1. Accordingly, the fuel receives a certain acceleration force and hence has momentum (e.g., $P=mv$, wherein m represents mass of fuel and v represents injection velocity of fuel), while the injector receives the momentum equal to P in a direction opposite to the injection direction of the fuel (hereinafter, referred to as an upward direction) according to action and reaction law of motion and is moved along the connection portion 2.

Function and effect of the injector clip according to an exemplary embodiment of the present disclosure will now be described in detail with reference to FIG. 6. The lower plate 10 may be supported on the upper end face of the fuel injection portion 1 and then the spring arm 40 may be inserted underneath the lower end face of the fuel inlet 3. For example, the present disclosure has a feature that height h1 from the injector engagement portion 42 of the spring arm 40 to the lower plate 10 is formed to be larger than height h2 between the fuel injection portion 1 and the fuel inlet portion 3 ($h1>h2$). Although difference between those heights may vary in the present disclosure, the height h1 from the injector engagement portion 42 to the lower plate 10 may be 2 mm greater than height h2 between the fuel injection portion 1 and the fuel inlet portion 3. Therefore, the injector clip according to the present disclosure may be inserted between the fuel inlet portion 3 and the fuel injection portion 1 while being compressed.

The injector clip according to an exemplary embodiment of the present disclosure may be disposed to have the connection portion 2 seated on the first seating aperture 11 and the second seating aperture 31. For example, an interval between a pair of plate engagement portions 41 may be formed to be less than the diameter of the connection portion 2. Therefore, the connection portion 2 may be inserted into and seated on both the first seating aperture 11 and the second seating aperture 31 while the plate engagement portions 41 are spread out with respect to both the first attachment or detachment recess 12 and the second attachment or detachment recess 32. In other words, the connection portion 2 may be coupled to and disposed between the lower plate 10 and the base plate 30.

Therefore, the lower plate 10 may be inserted into the lower side of the connection portion 2 and may abut the upper end face of the fuel injection portion 1. The base plate 30 may be inserted into and engaged with the middle position of the connection portion 2. The spring arm 40 may abut the lower face of the fuel inlet portion 3. Accordingly, when the injector clip is inserted into the injector, the lower plate 10 may elastically support the fuel injection portion 1. The base plate 30 may fix the position of the connection portion 2 and the spring arm 40 may elastically support the fuel inlet portion 3. In particular, the spring arm 40 and the lower plate 10, disposed at a first side and a second side with respect to the base plate 30, may elastically support the fuel inlet portion 3 and the fuel injection portion 1, respectively. When the injector operates, the fuel injection portion 1 may be pressed and pushed toward an upward direction due to reaction resulting from injection of fuel. Accordingly, the fuel injection portion 1 may be displaced toward the upward direction along the connection portion 2.

In particular, the spring arm 40 and the lower plate 10 may be compressed in both directions with respect to the base plate 30. The restoring force of the spring arm 40 and the lower plate 10 may move the fuel injection portion 1 and the fuel inlet portion 3 back to a position before fuel is injected. According to an exemplary embodiment of the present disclosure, unlike conventional injector clips having the spring structure that connects the fuel injection portion 1 and the fuel inlet portion 3 directly and supports them elastically, an effect of dispersing momentum of impact may be obtained by employing the plate 30 that engages with and supports the connection portion 2. Since the fuel injection portion 1 is elastically supported by the lower plate 10, the connection portion 2 may abut the base plate 30, the fuel inlet portion 3 may be elastically supported by the spring arm 40 and the lower plate 10, the base plate 30 and the spring arm 40 may be integrally formed, and the fuel injection portion 1 and the connection portion 2 and the fuel inlet portion 3 may be prevented from rotating with respect to each other.

Figure 4:
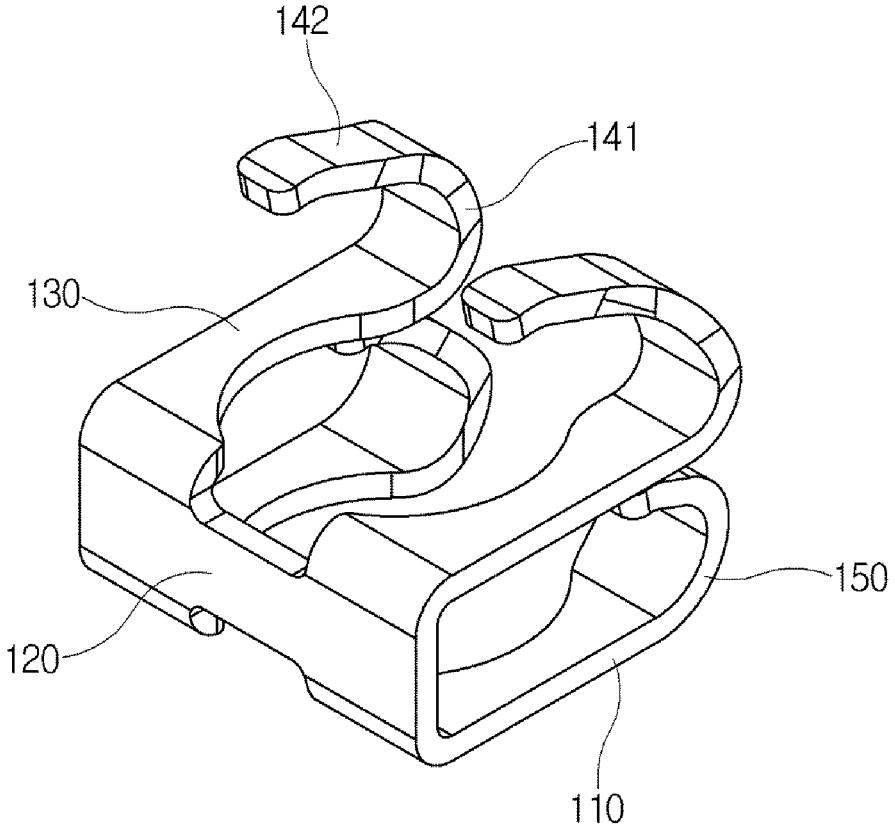
FIG. 4 is an exemplary perspective view of an injector clip according to an exemplary embodiment of the present disclosure.
Figure 5:
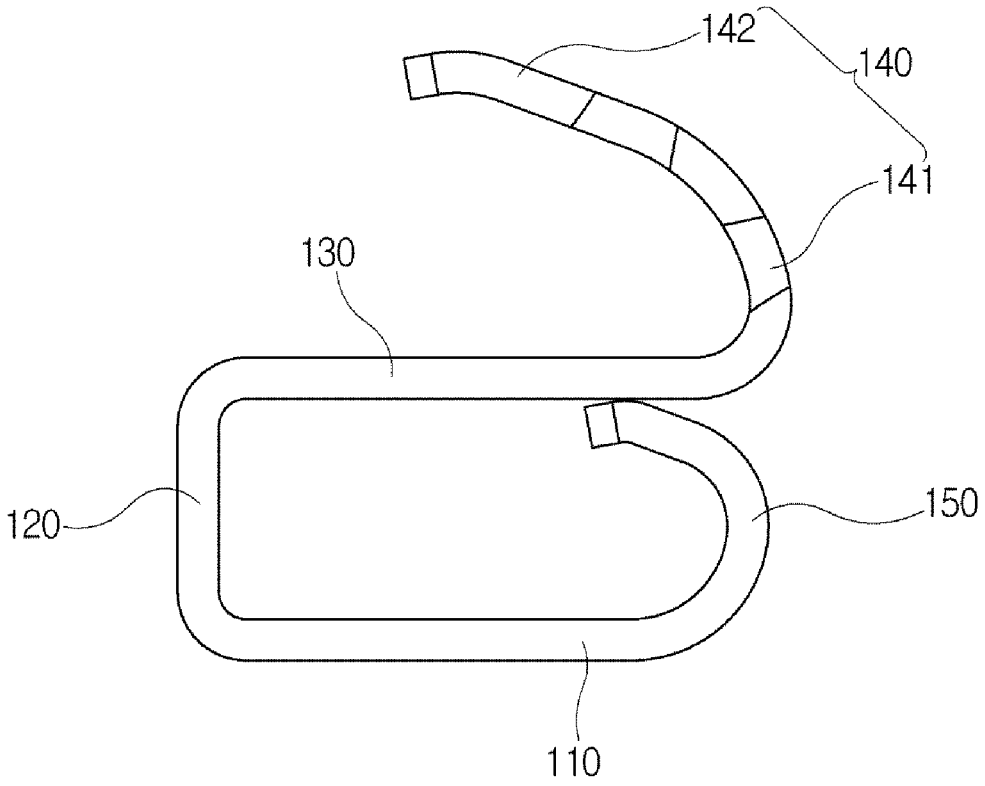
FIG. 5 is an exemplary side view of FIG. 4 according to an exemplary embodiment of the present disclosure.

FIGS. 4 and 5 show an exemplary embodiment of an injector clip according to the present disclosure. The injector clip according to this exemplary embodiment may include a lower spring arm 150 formed to extend from the lower plate 110 and to be bent in a direction toward the base plate 130 (e.g., in an upward direction). According to this exemplary embodiment, when the lower spring arm 150 is configured to be proximate to or in contact with the bottom surface of the base plate 130, the same effect two springs connected in parallel between the base plate 130 and the lower plate 110 may be generated. In other words, an effect of reinforcing coupling force of the engagement support portion 120 may be generated to reduce the impact of injecting fuel.

Although the present disclosure has been described in detail with reference to an exemplary embodiment thereof, it is obvious that this exemplary embodiment is just to illustrate and describe the present disclosure specifically by way of example but the present disclosure is not limited thereto and that the present disclosure can be modified or improved by those having ordinary skill in the art within the technical idea of the present disclosure. It is to be understood that simple modifications or changes fall within the spirit and scope of the present disclosure and that the spirit and scope of the present disclosure should be defined by the appended claims.

What is claimed is:

1. An injector clip comprising:

a lower plate that supports a fuel injection portion of an injector;

a base plate that contacts and supports a connection portion of the injector;

an engagement support portion that elastically supports the lower plate and the base plate to return a position of the fuel injection portion when the fuel injection portion is moved to its original position;

a spring arm formed by extending from the base plate to support a fuel inlet portion of the injector; and a lower spring arm formed by extension of the lower plate and being bent in a direction toward the base plate to reinforce supporting force of the engagement support portion.

2. The injector clip according to claim 1, wherein the lower plate a first end is coupled to the engagement support portion, having interior portion formed with a first seating aperture that seats the connection portion thereon and a second end that is opened to communicate with the first seating aperture.

3. The injector clip according to claim 2, wherein the lower plate has the connection portion inserted into the first seating aperture and abuts with an end face of the fuel injection portion in the direction of the fuel inlet portion to elastically support the fuel injection portion.

4. The injector clip according to claim 1, wherein the base plate is formed having a first end coupled to the engagement support portion, an interior portion having a second seating aperture to seat the connection portion thereon and a second end is formed to be opened to communicate with the second seating aperture.

5. The injector clip according to claim 4, wherein the base plate receives the connection portion therein and is supported by the second seating aperture.

6. The injector clip according to claim 1, wherein the engagement support portion is integrally formed with the lower plate and the base plate and formed by being bent twice having the lower plate and the base plate disposed with each other.

7. The injector clip according to claim 1, wherein the spring arm has a first end coupled to the base plate and formed by being bent convexly with respect to the base plate and a second end that abuts the fuel inlet portion and formed having width of a face coupled to the base plate being greater than width of a face that abuts the fuel inlet portion.

8. The injector clip according to claim 1, wherein the lower spring arm is configured to be bent in a direction from the second end of the lower plate toward the base plate having the lower spring arm that covers a bottom face of the base plate or abuts the bottom surface of the base plate.

* * * * *